United States Patent [19]

Fontlladosa

[11] Patent Number: 4,572,361

[45] Date of Patent: Feb. 25, 1986

[54] DISPLAY SYSTEM FOR CONSUMER FLUID PRODUCT CONTAINERS

[75] Inventor: Enrique B. Fontlladosa, Barcelona, Spain

[73] Assignee: Uniconfis Corporation, Atlanta, Ga.

[21] Appl. No.: 639,369

[22] Filed: Aug. 9, 1984

[51] Int. Cl.[4] ..... B65D 1/36; B65D 5/44

[52] U.S. Cl. ..... 206/45.19; 206/45.14; 206/277; 206/561; 206/563; 206/564

[58] Field of Search ..... 206/587, 592, 277, 561, 206/563, 564, 45.19, 45.14

[56] References Cited

U.S. PATENT DOCUMENTS

| | | | |
|---|---|---|---|
| 1,966,734 | 7/1934 | Rosen | 206/45.19 |
| 3,061,089 | 10/1962 | Higgins | 206/45.19 |
| 3,768,639 | 10/1973 | Dogliotti | 206/564 |
| 3,856,137 | 12/1974 | Brindley | 206/564 |
| 4,291,805 | 9/1981 | Seeley | 206/564 |
| 4,448,303 | 5/1984 | Beckenfeld | 206/45.19 |
| 4,454,949 | 6/1984 | Flum | 206/563 |
| 4,485,922 | 12/1984 | Desmond et al. | 206/564 |

FOREIGN PATENT DOCUMENTS

| | | | |
|---|---|---|---|
| 1170939 | 1/1959 | France | 206/277 |
| 287719 | 2/1965 | Netherlands | 206/45.19 |
| 819995 | 9/1959 | United Kingdom | 206/45.14 |
| 1513426 | 6/1978 | United Kingdom | 206/564 |

*Primary Examiner*—William T. Dixson, Jr.
*Assistant Examiner*—Brenda J. Ehrhardt
*Attorney, Agent, or Firm*—Philip J. Zadeik

[57] ABSTRACT

A display system is provided for consumer fluid product containers of the tubular, crimped-end type. A carton whose top panel can be folded back to reveal the contents and form a display board receives a tray having a series of parallel rows. Each row or trough has one or more individual pockets formed by low partitions, and each pocket has a plurality of members projecting from either pocket side to releasably grip a received crimped container end. The pockets of any one row are skewed from the pockets of the row before it or behind it, creating a close packing, mutual support and fixed positioning of the containers inside the carton.

6 Claims, 6 Drawing Figures

Fig. 3.
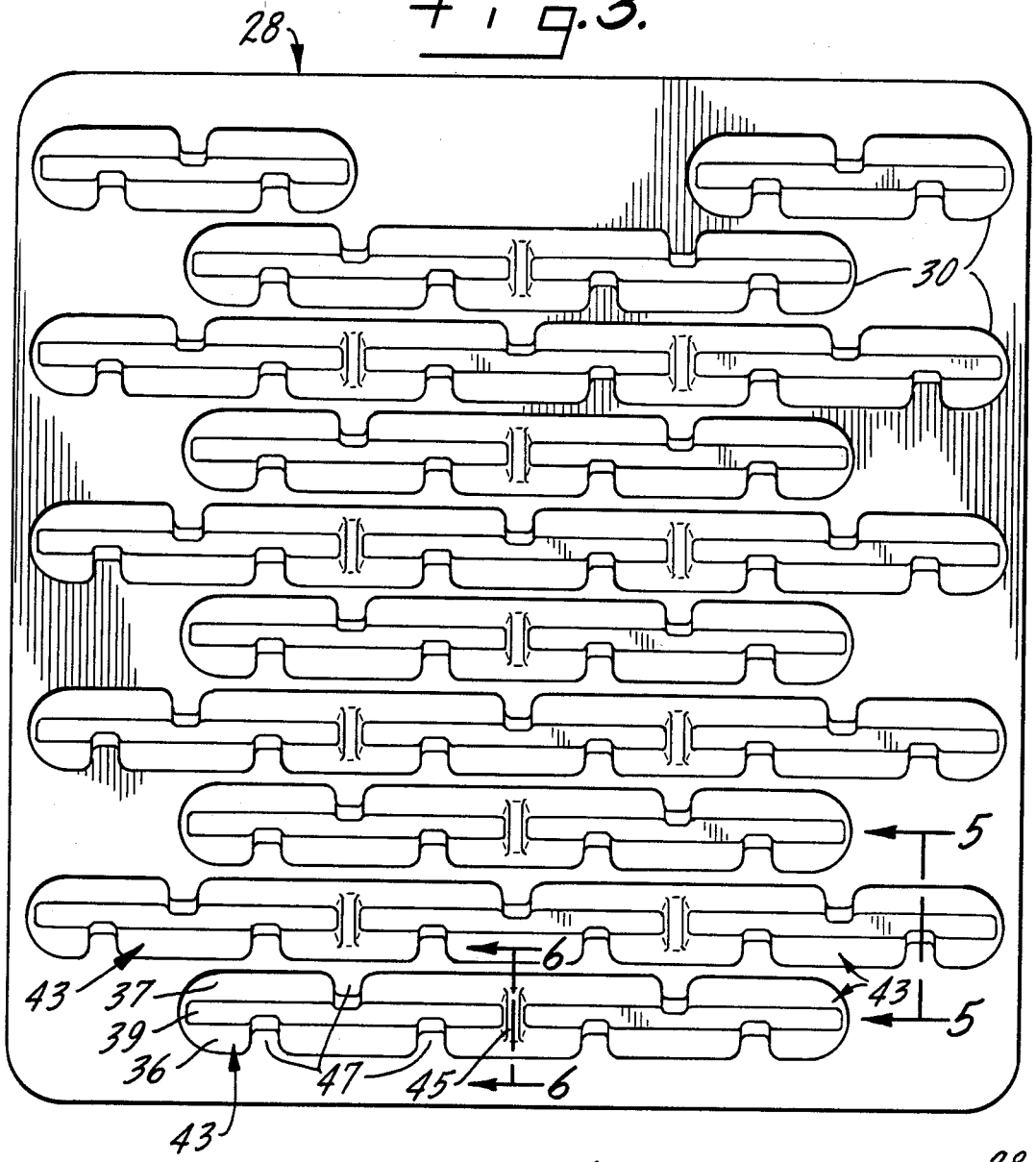
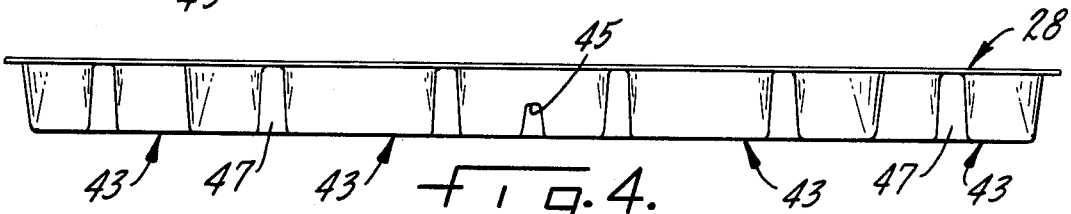
Fig. 4.
Fig. 5.
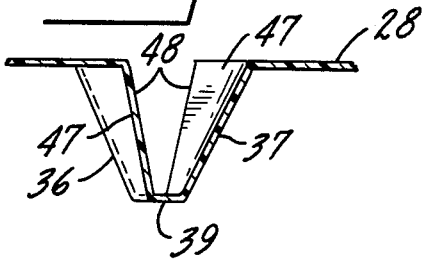
Fig. 6.
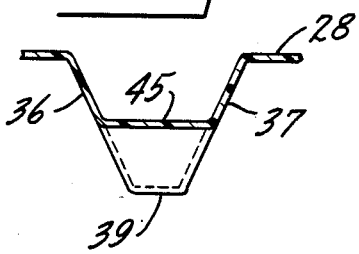

DISPLAY SYSTEM FOR CONSUMER FLUID PRODUCT CONTAINERS

This invention relates generally to the display and packaging of consumer products, and more specifically to the display and packaging of consumer fluid product containers.

Consumer fluid products in squeezable tubes have been known in the art, most notably for packaging tooth paste. Other fluids packaged in this way have included such items as shampoo or glue. The well-known toothpaste-tube style of packaging has been remarkably economical to manufacture, and has provided the consumer with a method of dispensing the fluid product (squeezing the tube) that does not require the use of a separate implement such as a spoon.

There has been, however, a problem associated with such tubes in that their shape is awkward. This type of tube is flat on one end and generally has a cylindrical second end, which second end is sealed with a circular plate. Usually, a protruding orifice for dispensing the product is centered on the plate or head, and may be provided with a cap. The overall shape which these features present cannot be stood on either end with any degree of stability, nor can it be conveniently stacked with other similar shapes. It is difficult to form them into an orderly and attractive display at the point of sale.

Another problem related to the awkward shape is the difficulty in packing the containers in a carton for shipment. Such containers, if packed loosely, will not stay in any fixed position, but will bang against each other and the walls of the carton, increasing damage.

The industry has generally solved this problem by providing a rectangular box for each unit. Obviously, such boxes can be stacked, packed and displayed with a high degree of efficiency and neatness, but the external shape of each unit is of necessity nondescript. Little consumer recognition can attach to a rectangular box. Further, the cost of each unit is substantially increased by the provision of such a box.

SUMMARY OF THE INVENTION

Accordingly, it is a principal object of the invention to provide means for the packing and orderly display of consumer fluid product containers.

Another object of the invention is to provide means for holding consumer fluid product containers of the tube type in fixed, closely packed positions so as to prevent damage during shipment.

A further object of the invention is to provide a fluid product container display tray which will hold fluid product containers in fixed, orderly and attractive positions.

Yet another object of the invention is to provide a carton and tray packing and display system to securely hold fluid product containers of the tube type.

Further objects of the invention will become apparent from the detailed description of a preferred embodiment which follows.

According to the invention, tube-type fluid product containers are provided with a carton/display enclosure, the top of which may preferably be refolded into a display panel, thus revealing the contents. The containers are held in a substantially upright position inside of the carton by a tray with a series of troughs.

Each trough is divided into one or more sections, each section receiving the flattened end of a container. Each section has a plurality of supports which project from the trough's sides. The supports are adapted to grip the sides of the container so as to support it in a substantially upright position.

The sections in any one trough or row are offset in a side direction from either the sections in front of them or the sections behind them. In this way the tray achieves closest packing of the partly cylindrical containers, which are therefore held in fixed positions by the tray and each other during shipment so as to minimize damage. At the same time, the tray provides for an attractive and orderly display of the containers inside the opened carton.

BRIEF DESCRIPTION OF THE DRAWINGS

Reference is now had to the drawings, wherein

FIG. 3 is a plan view of the support tray;

FIG. 4 is a front elevation of the support tray;

FIG. 5 is a side elevational section taken substantially along line 5—5 of FIG. 3; and FIG. 6 is a side elevational section taken substantially along line 6—6 of FIG. 3.

DETAILED DESCRIPTION OF A PREFERRED EMBODIMENT

Figure 1:
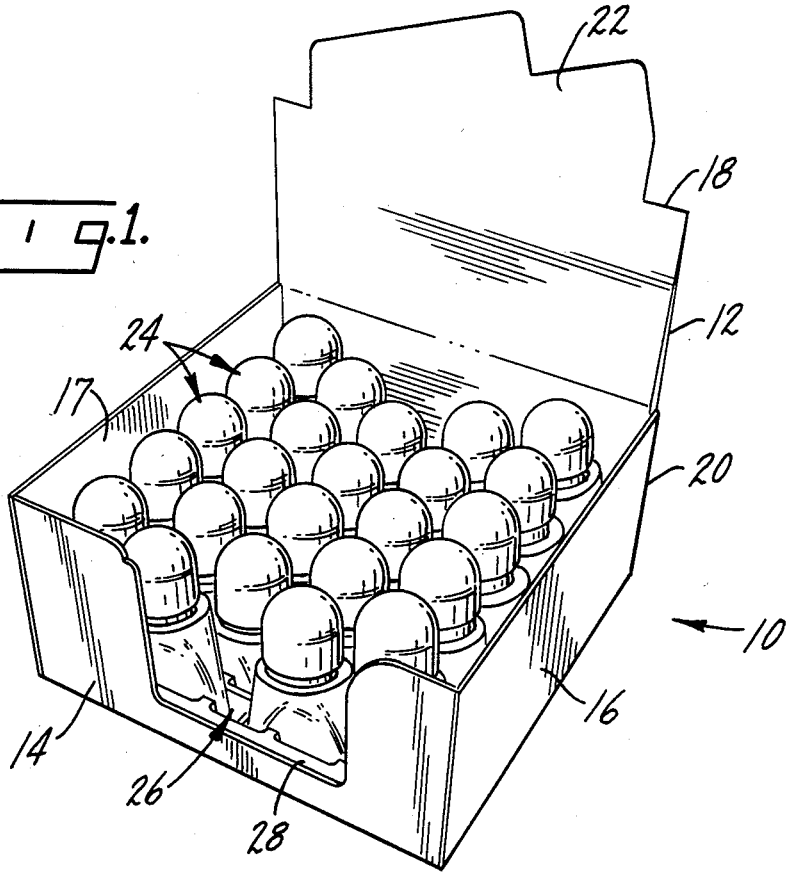
FIG. 1 is a perspective view of the display carton showing the display of a plurality of containers.

Referring to FIG. 1, there is shown a display/container or carton 10 which incorporates the invention. Carton 10 preferably has a flap 12, previously joined to front panel 14 and side panels 16, 17 to form a shipment container and preferably divided therefrom by perforations. Upon opening the container, flap 12 is separated from front panel 14 and side panels 16, 17, lifted up, folded upon itself along fold line 18 and tucked in along rear panel 20. Pop-up area 22, separated from the remainder of flap 12 along a preperforated line, is suitably shaped to display advertising material printed thereon. When carbon 10 is thus formed into a display, the consumer may view the fluid containers 24 through viewing area 26 in front panel 14, as well as through the exposed top.

Holding fluid containers 24 in easily removable but secure positions is tray 28 inserted into the bottom of carbon 10. Tray 28 has a plurality of rows 30 (See FIG. 2) in which the thin, crimped ends of containers 24 sit. Containers 24 are positioned such that the containers in any one row are skewed or offset in a side-to-side direction from the containers in front or behind them.

Figure 2:
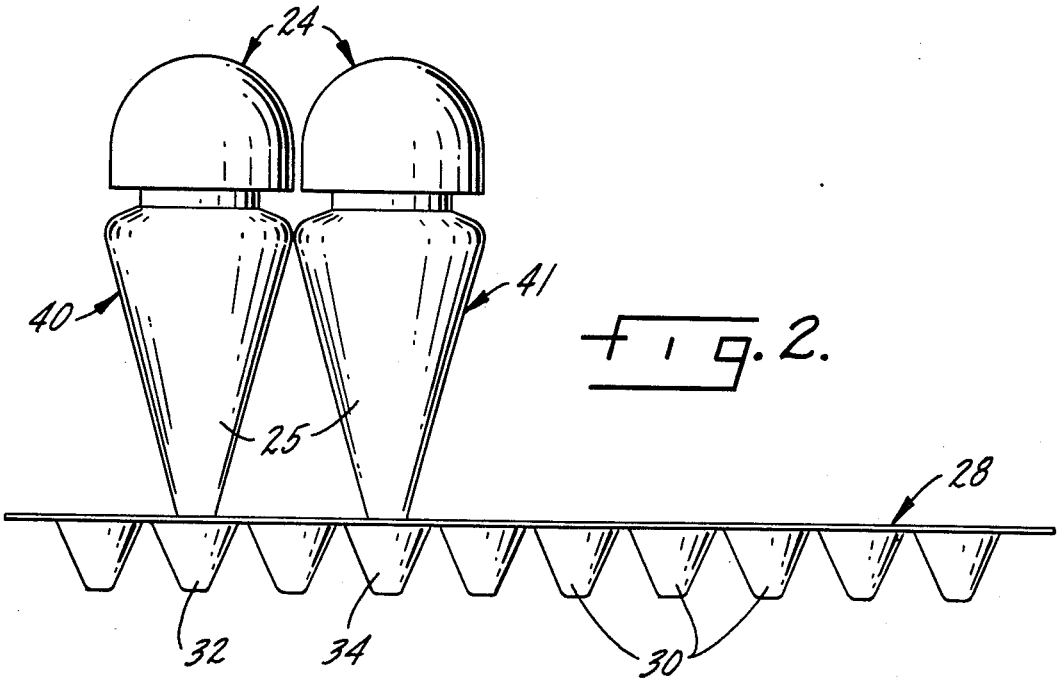
FIG. 2 is a side elevation of the support tray, showing the support of a pair of tube containers inserted therein.

FIG. 2 shows the front-to-back spacing of containers 24 in rows 30. The front-to-back spacing between the center lines of second row 32 and fourth row 34, or any other pair of rows two rows apart, are substantially equal to the largest diameter of tube containers 24. In FIG. 2, container 40 is directly in front of container 41. In combination with the skewing of one row of containers from the next, this arrangement provides for the closest-packing and mutual support of containers 24 in the carton.

Referring to FIGS. 3–6, a preferred shape of tray 28 is shown. Each row 30 generally takes the shape of a V-shaped trough, as defined by sides 36, 37 and bottom 39. Those rows 30 which are adapted to receive more than one container 24 are divided into pockets 43 by partitions 45, which project upward from bottom 39 preferably by a fraction of the total depth of the row. Partitions 45 act as guides so that each container 24 will be placed in a respective pocket 43.

Each pocket 43 also has a plurality of outstanding gripping members 47, some of which project from front side 36 of the pocket and others of which project at other locations from the rear side 37. As can best be seen in FIG. 5, surface 48 of each member 47 preferably has a steeper slope than the side from which it projects.

Pockets 43 and projecting members 47 are preferably integrally formed as a part of tray 28 out of a substance such as PVC or molded plastic. Tube portions 25 of containers 24 (See FIG. 2) are preferably formed of a resilient, deformable material such as PVC or flexible plastic. When containers 24 are placed in pockets 43, members 47 grip and slightly deform the sides of container 24, thereby providing sufficient suport to assure that containers 24 stand in a substantially upright condition, but allowing the containers to be easily removed.

In one embodiment, members 47 projecting rearwardly from front side 36 of each pocket exceed in number the members 47 projecting frontwardly from rear side 37. Where members 47 are not across from each other but are distributed along side walls 36 and 37, the effect is to cause each container 24 to lean slightly backwardly. Advertising material present on the face of each container 24 is thereby made more visible to the customer.

While the above describes a preferred embodiment of the invention, variations of it may be easily arrived at, such as variations in the number of pockets or rows, or variations in the exact shape of each pocket. Accordingly, the claimed subject matter of the invention is not to be limited by the detailed description, but only by the scope of the claims.

I claim:

1. A tray for the upstanding display of containers, said containers being of a generally tubular configuration having one cylindrical end and one flat end, said tray including a plurality of troughs, each trough having a pair of generally opposed side walls, at least some of the troughs being divided into a plurality of discrete pockets, said pockets receiving the flat end of said containers, each pocket having a plurality of gripping members protruding inwardly from the side walls creating a gripping force directed towards the sides of the container near its flat end, each trough being of sufficient depth to support the container in a substantially upright position.

2. The tray of claim 1 wherein:

said troughs are positioned in parallel rows, the arrangement of pockets in any row being skewed from the arrangement of pockets in any adjacent row such that the containers placed in the pockets of one row will be substantially aligned with the containers in alternate rows.

3. The tray of claim 1 wherein:

said troughs are generally V-shaped as defined by forward and rearward walls joined at the bottom of the trough by a floor means, the number of gripping members protruding from the forward wall in each pocket exceeding the number of gripping members protruding from the rearward wall, whereby said supported containers lean slightly rearwardly.

4. The tray of claim 1, further characterized in that it is made of plastic.

5. The tray of claim 1, further characterized in that it is horizontally dimensioned to be received within a rectangular carton.

6. A system for the storage and display of containers holding consumer fluid products, the system comprising a carton, a tray and a plurality of fluid containers, said containers having a generally tubular configuration with one cylindrical end and one flat end, said tray comprising a plurality of troughs of a V-shaped configuration defined by forward and rearward walls joined by a floor means, at least some of said troughs divided into a plurality of pockets, each pocket receiving the flat end of said containers, each of said troughs are of sufficient depth to support a container in a substantially upright position, said troughs are positioned in parallel rows, the arrangement of said pockets in said troughs are skewed so that the containers in one row will not be aligned with the containers in any adjacent row, but will be substantially aligned with the containers in any alternate row, the cylindrical end of said containers having a diameter substantially equivalent to the distance between the centers of two alternate troughs, said tray having generally parallel sides at right angles to the troughs, at least some troughs approaching in length the distance between two parallel sides, the tray being adapted to be received inside of the carton, the carton being roughly the same height as a container and having a top and front portion adapted to be uncovered from the contents of the carton and turned into a display board, the structure of the configuration of the containers resulting in close packing, mutual support and fixed display, the containers being in display position upon opening of the carton.

* * * * *